US006698058B2

(12) United States Patent
Cann

(10) Patent No.: US 6,698,058 B2
(45) Date of Patent: Mar. 2, 2004

(54) STAND UP DUSTPAN

(75) Inventor: Robert A. Cann, Amherst, MA (US)

(73) Assignee: Milla Company, Inc., Amherst, MA (US)

( * ) Notice: Subject to any disclaimer, the term of this patent is extended or adjusted under 35 U.S.C. 154(b) by 76 days.

(21) Appl. No.: 10/041,140

(22) Filed: Jan. 7, 2002

(65) Prior Publication Data

US 2002/0088075 A1 Jul. 11, 2002

Related U.S. Application Data

(60) Provisional application No. 60/260,055, filed on Jan. 6, 2001.

(51) Int. Cl.[7] ..... A47L 13/52

(52) U.S. Cl. ..... 15/257.1; 15/257.9

(58) Field of Search ..... 15/257.1, 257.2, 15/257.3, 257.4, 257.5, 257.6, 257.7, 257.8, 257.9; 294/1.4

(56) References Cited

U.S. PATENT DOCUMENTS

| | | | | |
|---|---|---|---|---|
| 341,175 | A | * | 5/1886 | Shaw |
| 1,182,190 | A | * | 5/1916 | Magami |
| 1,605,534 | A | * | 11/1926 | Dupre |
| 3,170,183 | A | | 2/1965 | Leatherman |
| 4,631,774 | A | | 12/1986 | Kania |
| 4,709,436 | A | * | 12/1987 | Berfield |
| D351,699 | S | | 10/1994 | Temple |
| D383,002 | S | | 9/1997 | Rigney |
| D389,629 | S | | 1/1998 | France |
| 5,799,993 | A | * | 9/1998 | Lafferty |
| 6,233,781 | B1 | * | 5/2001 | Savage |

FOREIGN PATENT DOCUMENTS

| | | | |
|---|---|---|---|
| FR | 655174 | * | 4/1929 |
| FR | 1050546 | * | 9/1953 |

OTHER PUBLICATIONS

"DustBuCan" product from Brazil, as described in prior art section on page 2 of applicant's *Stand Up Dustpan* specification, and illustrated in FIG. 1A on sheet 1 of applicant's drawings.

Dustpan manufactured by Rubbermaid Inc. of Wooster, Ohio, as described on page 2 of applicant's *Stand Up Dustpan* specification, and illustrated in FIG. 1B on sheet 1 of applicant's drawings. Rubbermaid has a design patent (Des. 389,629) on the rib pattern centrally located within the pan perimeter, but to the applicant's best knowledge and research, the product itself was not patented by Rubbermaid.

* cited by examiner

*Primary Examiner*—Randall E. Chin

(57) ABSTRACT

An improved dustpan includes an elongated receptacle with a lip at one edge of the perimeter of the receptacle and a handle or grip attached to the opposite edge. The handle extends away from the perimeter edge of the receptacle opening in a direction perpendicular to the lip and is unsupported at its far end. The elongated receptacle extends beneath the handle at least as far as the end of the handle, and can extend further. The elongated receptacle has a flat end wall that permits the dustpan to be stored upright without emptying or spilling its contents. In its upright storage position the dustpan lip is upward and the handle is downward. The end of the handle can stabilize the dustpan in its upright storage position. Several of the dustpans can be nested.

2 Claims, 6 Drawing Sheets

STAND UP DUSTPAN

This application claims the benefit of provisional application No. 60/260,055 filed Jan. 6, 2001.

FIELD OF THE INVENTION

This invention relates to a dust collecting apparatus generally known as a dustpan, and more particularly to a dustpan that retains its contents while in a self-supporting upright storage position.

1. Background of the Invention

The use of dustpans to pick up dirt and debris is well known. Many prior art designs exist. These may be one piece or multiple piece constructions, employ metallic or molded materials, and show numerous ornamental variations. The most popular and generally accepted design in widespread use consists of a shallow pan with an open lip at one end, and an elongated handle or grip attached to the opposite end. This handle extends outward from the pan in a direction more or less perpendicular to the lip, thus providing a handy and convenient means for manipulating the dustpan. This design, however, cannot be stored upright without spilling most or all of its contents, and is thus impractical and messy to store unless another receptacle is immediately at hand to receive the dustpan's contents. Therefore, a dustpan design that could be stored upright without spilling or emptying its contents, but is nevertheless similar to generally accepted designs, would be a useful and novel invention.

2. Description of Prior Art

U.S. Pat. No. 4,631,774 discloses a dust collecting apparatus that is standable or self-supporting in a storage position. However, this dustpan cannot hold dust or debris in its storage position because the open lip is downward, and thus, any contents will spill out. In addition, the user may not recognize the flat shallow flap that is intended for use as a handle or grip.

U.S. Pat. No. 3,170,183 discloses a wastebasket with a lip along one top edge and one or two handle slots in the opposite wall. Though this device holds dirt and debris in its upright storage position, it does not have the elongated handle or grip that readily identifies it to the user as a dustpan.

U.S. Pat. No. Des. 351,699 discloses a trash collection container with an extended lip. As in the previous example, this device does not have the elongated handle or grip that readily identifies it to the user as a dustpan. In addition, it appears to have a separate removable top more characteristic of a trash container than a dustpan.

U.S. Pat. No. Des. 383,002 discloses a combined brush, dustpan, and waste can wherein the waste can has a flat lip characteristic of a dustpan, and will hold dust and debris in an upright storage position. However, the waste can component again does not have the recognizable elongated handle or grip of most dustpans, nor does the dustpan component. Instead the user must hold onto a flared top edge opposite the lip that is parallel rather than perpendicular to the lip. In addition, dust and debris can spill out of the dustpan component of this device because it does not have a flat and stable base. It must be stored in a nested position within its corresponding wastebasket to hold dust and debris without spilling.

Illustrated in PRIOR ART FIG. 1A is the DustBuCan, a molded product made in Brazil by Plasutil and distributed in the U.S. by Kaminstein Imports. It is describe on its product label as a combination dustpan, bucket, and trashcan. Though it can hold dust and debris in its upright storage position, it again does not have the elongated grip or handle that readily identifies it as a dustpan. Instead it has a handle hole in the top edge opposite the lip that is parallel to the lip.

Illustrated in PRIOR ART FIG. 1B is a dustpan manufactured by Rubbermaid Inc. of Wooster, Ohio. Though it has a receptacle to hold dust and debris, the end of its handle extends so far beyond the end of its receptacle that it is not self supporting in an upright storage position. Instead it tips over towards its lip, spilling most of its contents.

SUMMARY OF THE INVENTION

The principle object of my invention is to provide a novel, useful, simple, and recognizable dustpan that stores a generous amount of contents in an upright storage position, thus overcoming the above enumerated deficiencies in known prior art.

My invention employs the use of a dustpan shape of the type having a lip at one end and an elongated handle or grip extending outward from the opposite end in a direction more or less perpendicular to the lip. The handle extends away from the perimeter edge of the receptacle in a direction perpendicular to the lip and is unsupported at its far end. However, instead of the shallow pan generally characteristic of prior art of this type, my invention shows an enlarged and elongated dust receptacle extending under the handle or grip to a distance at least as far as the end of the aforementioned handle. This receptacle is tapered for ease of removal from a molding die, and has a more or less flat end wall at nearly a right angle to its bottom wall, such that it stabilizes and holds the dustpan in its upright storage position with the lip upward and the handle downward. A preferred embodiment shows the handle end and the far corners of the receptacle end wall forming a stable tripod base for its upright storage position. Alternatively, the receptacle end wall may extend well beyond the handle, as long as it is flat enough and correctly angled to provide a stable base for upright storage.

It is a further object of my invention to provide a dustpan that is attractive, inexpensive, stackable, washable, sturdy, and easily injection moldable in a shape without restrictions requiring mechanical side actions in the molding die. Dies without side actions are less expensive to fabricate and maintain, and more readily permit the resulting molded shapes to be nested economically for inventory, shipping and display.

Another object of my invention is to provide a novel means of molding a shallow curved lip without requiring a curved parting line in that portion of the molding die. The advantage of a shallow curved lip is that it allows the user to maintain pressure against the floor without having the lip distort upward and allow dirt to be swept underneath. The advantage of die parting lines that are not curved is that they are less expensive to fabricate and maintain.

These and additional objects of my invention will be apparent upon studying the following detailed description and accompanying drawings.

REFERENCE NUMERALS USED IN DRAWINGS

Figure 1:
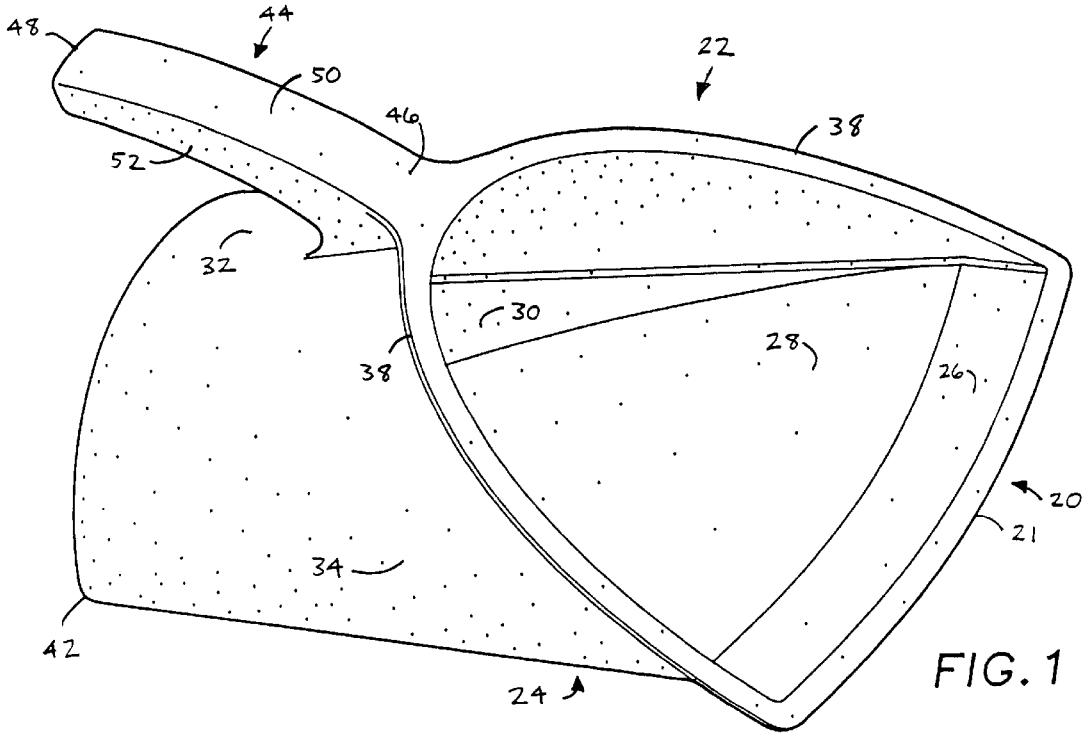
FIG. 1 is a top left front perspective view of my invention.
Figure 2:
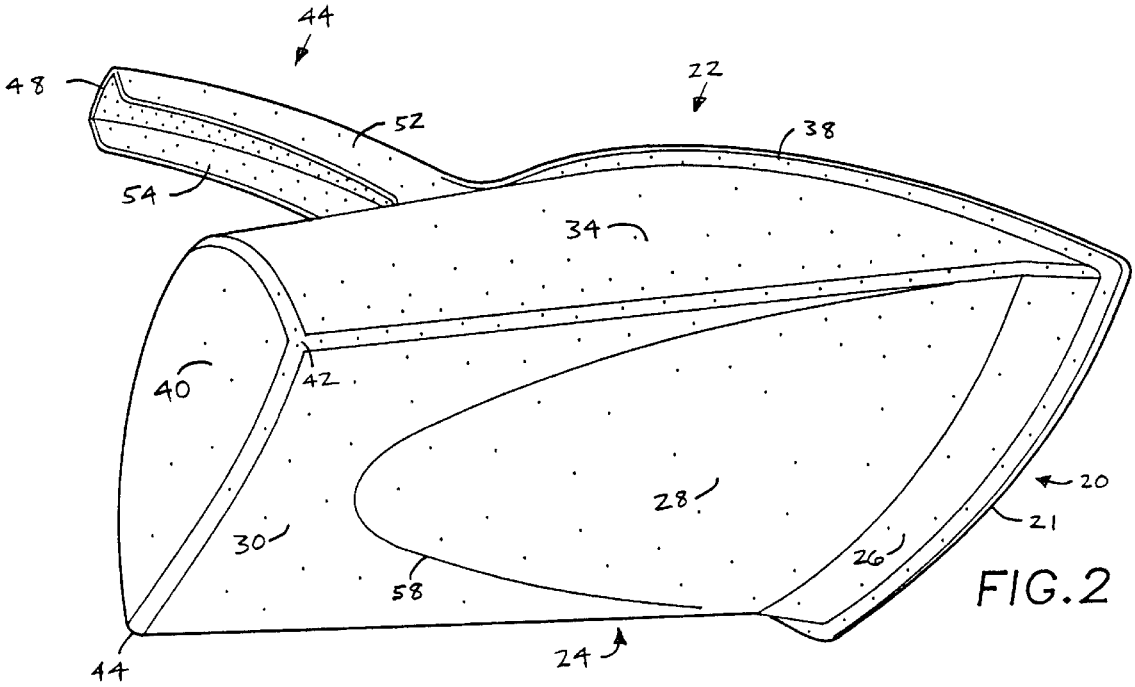
FIG. 2 is a bottom left back perspective view thereof.
Figure 1A:
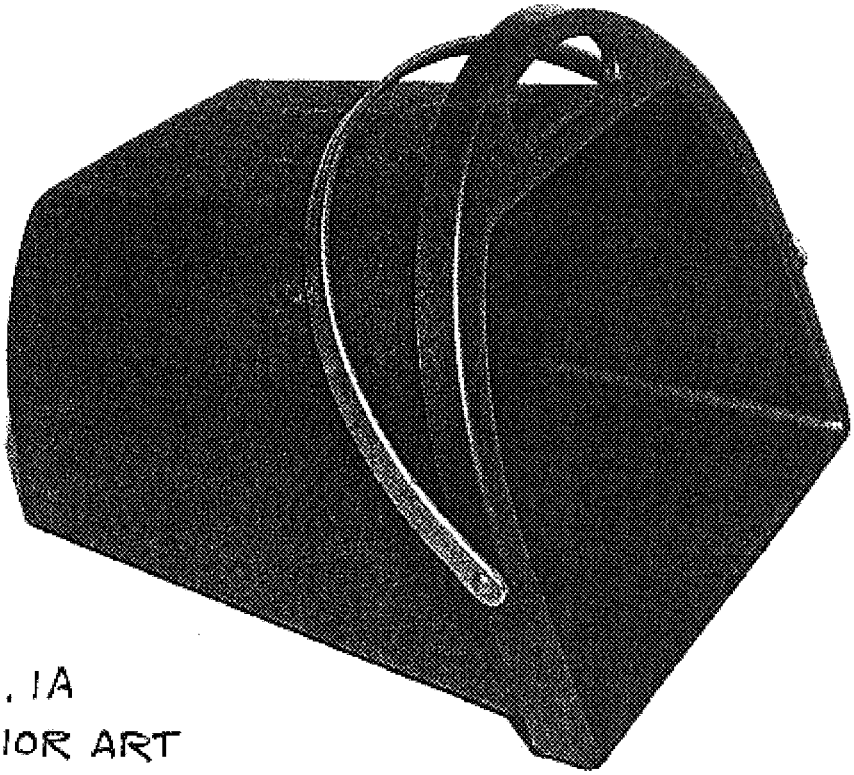
FIG. 1A PRIOR ART
FIG. 1A is a perspective view of prior art.
Figure 1B:
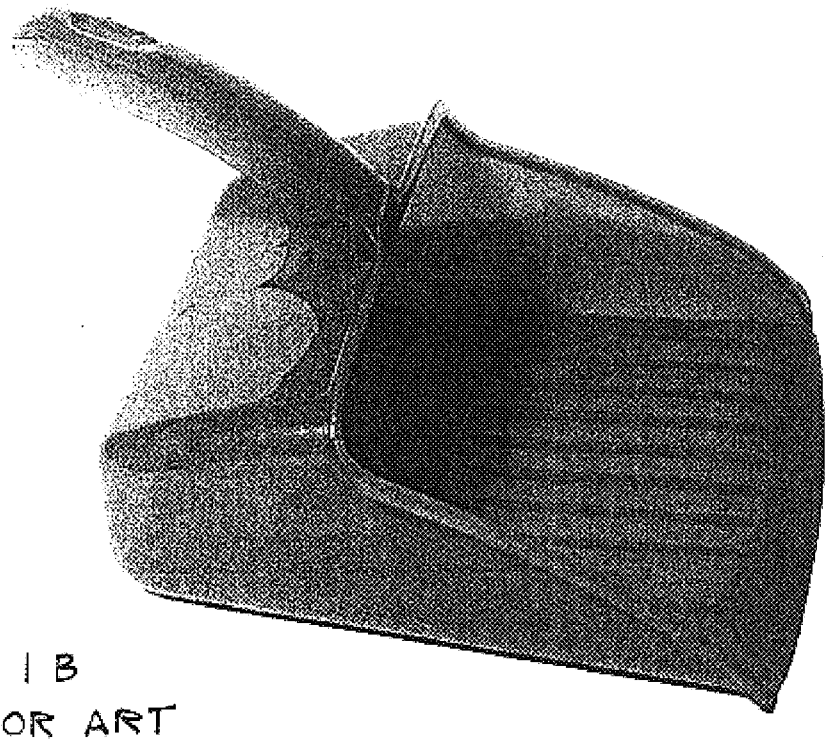
FIG. 1 B PRIOR ART
FIG. 1B is a perspective view of prior art.
Figure 3:
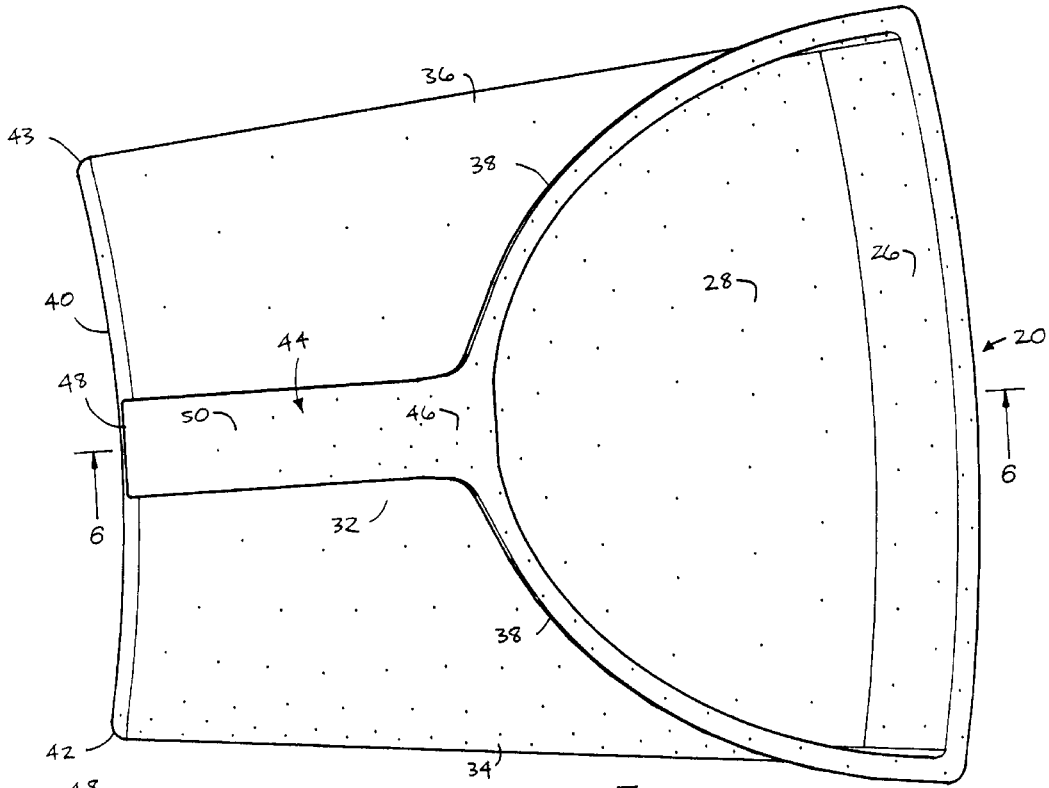
FIG. 3 is a top view thereof.
Figure 4:
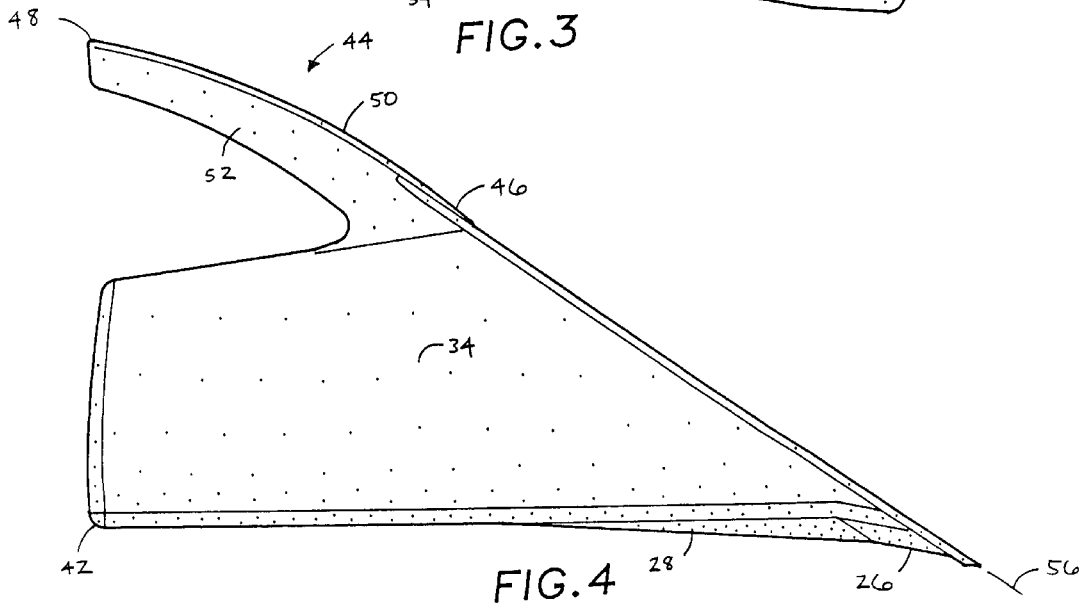
FIG. 4 is a left side view thereof, the right side view being a mirror image.
Figure 5:
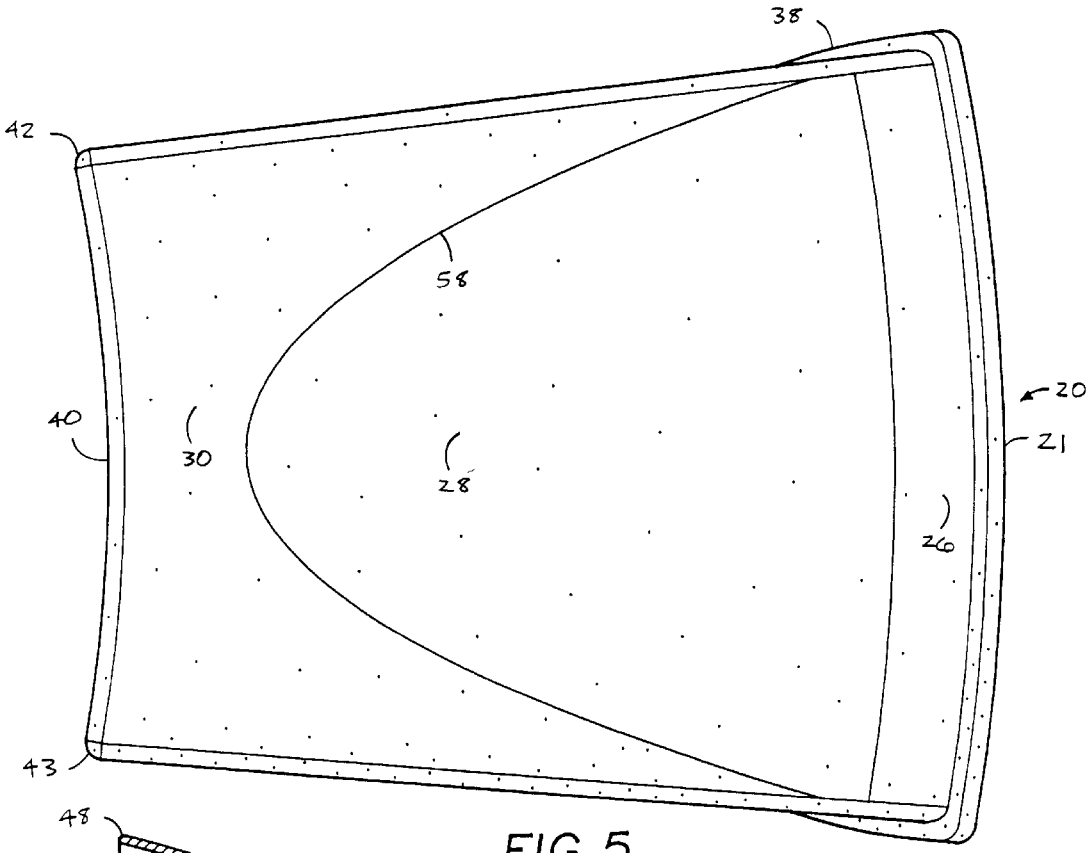
FIG. 5 is a bottom view thereof.
Figure 6:
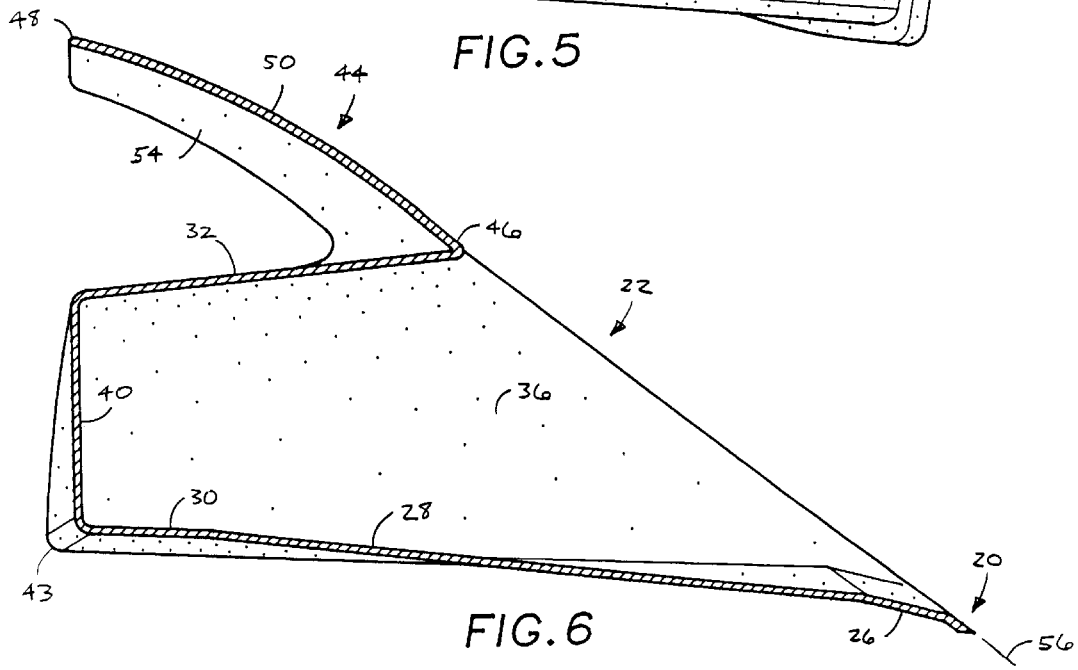
FIG. 6 is a cross-sectional view along the lines 6—6 of FIG. 3.
Figure 7:
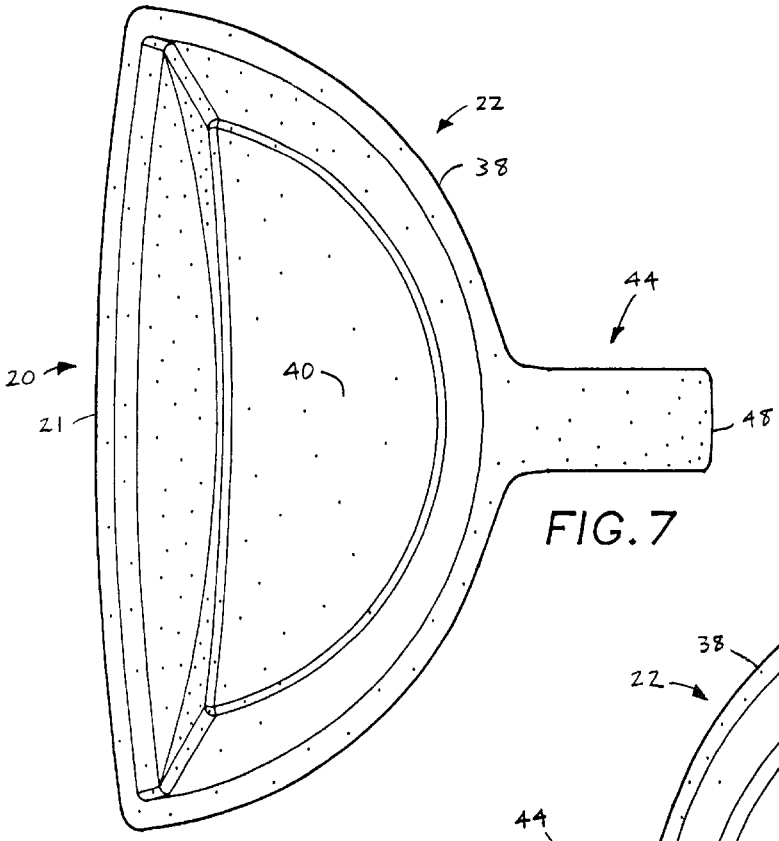
FIG. 7 is a front view thereof.
Figure 8:
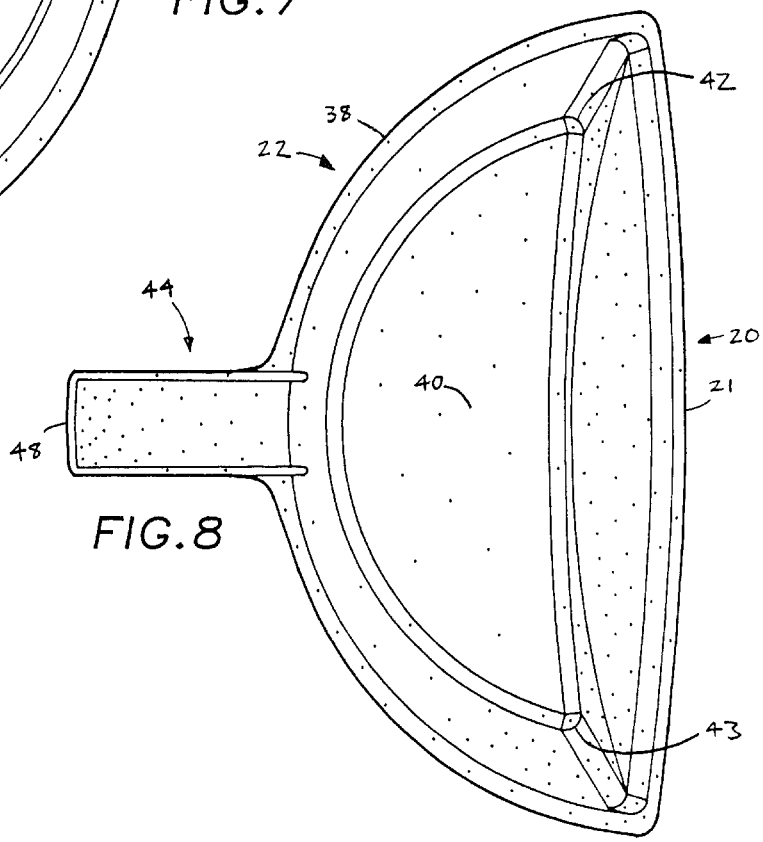
FIG. 8 is a back view of my invention.

20 lip
21 lip, central portion
22 receptacle
24 receptacle bottom
26 receptacle bottom, portion adjacent to lip
28 receptacle bottom, central portion
30 receptacle bottom, portion furthest from lip
32 receptacle top
34 receptacle left side
36 receptacle right side
38 receptacle flange
40 receptacle end wall
42 left corner of receptacle end wall
43 right corner of receptacle end wall
44 handle
46 handle end towards lip
48 handle far end
50 handle top
52 handle left side
54 handle right side
56 die parting line plane
58 parabolic intersection line

DETAILED DESCRIPTION OF THE DRAWINGS

Referring to FIG. 1 through FIG. 8, the dustpan according to my invention generally includes a lip 20, a receptacle 22, and a handle 44. The receptacle has a floor or bottom 24 connecting the lip 20 to a receptacle end wall 40. The receptacle has a top 32 that arches over the bottom from a left side 34 to a right side 36. The top 32, bottom 24, sides 34, 36, and end wall 40 thus described, form an open-top receptacle. Preferably the top 32 and sides 34,36 form a continuous arch over the bottom, and thus, viewed from the front, a generally D-shaped opening is seen. However, this is not the only shape that will provide benefits according to my invention. For example, the curvature of the sides and top can be varied to form a more triangular or more rectangular opening. Furthermore, it is not necessary that the shape be symmetrical. To aid removal from a molding die the receptacle 22 thus formed is preferably tapered or reduced in size towards the receptacle end wall 40 with a draft angle of between three and seven degrees, though embodiments of my invention can employ other draft angles.

Viewed from either side, the open top of the receptacle angles acutely back from the lip 20 towards the end wall 40, preferably at an angle of between thirty-five and fifty degrees, though other acute angles may be used. Alternatively the opening may be curved as viewed from the sides, though molding dies with curved parting lines are more expensive to make and maintain. The handle 44 is positioned more or less perpendicular to the dustpan lip 20, this being the orientation most commonly seen and recognized for its superior functionality in use. More specifically, the handle end 46 towards the lip attaches centrally to that portion of the receptacle top 32 nearest the lip. The handle far end 48 is unsupported and extends away from the receptacle 22 in a direction more or less perpendicular to the lip 20. Viewed from the top, the acutely angled sides 34, 36 combine with the perpendicularly attached handle 44 to form generally a Y-shape, with the closed end of the receptacle extending underneath the handle.

Preferably a narrow flange 38 around the receptacle top 32 connects the handle top 50 to the ends of the lip 20, acting as a stiffening member. Short handle sides 52, 54 extend downward from the handle top 50 to the receptacle top 32, also acting as stiffening members. The size of these stiffening members may vary, depending on the size and wall thickness of my dustpan. Preferably the whole dustpan is injection molded of thermoplastic resin between 0.060 and 0.120 inches thick, but other materials and thickness dimensions can be employed, and uniform thickness is not a requirement.

Figure 9:
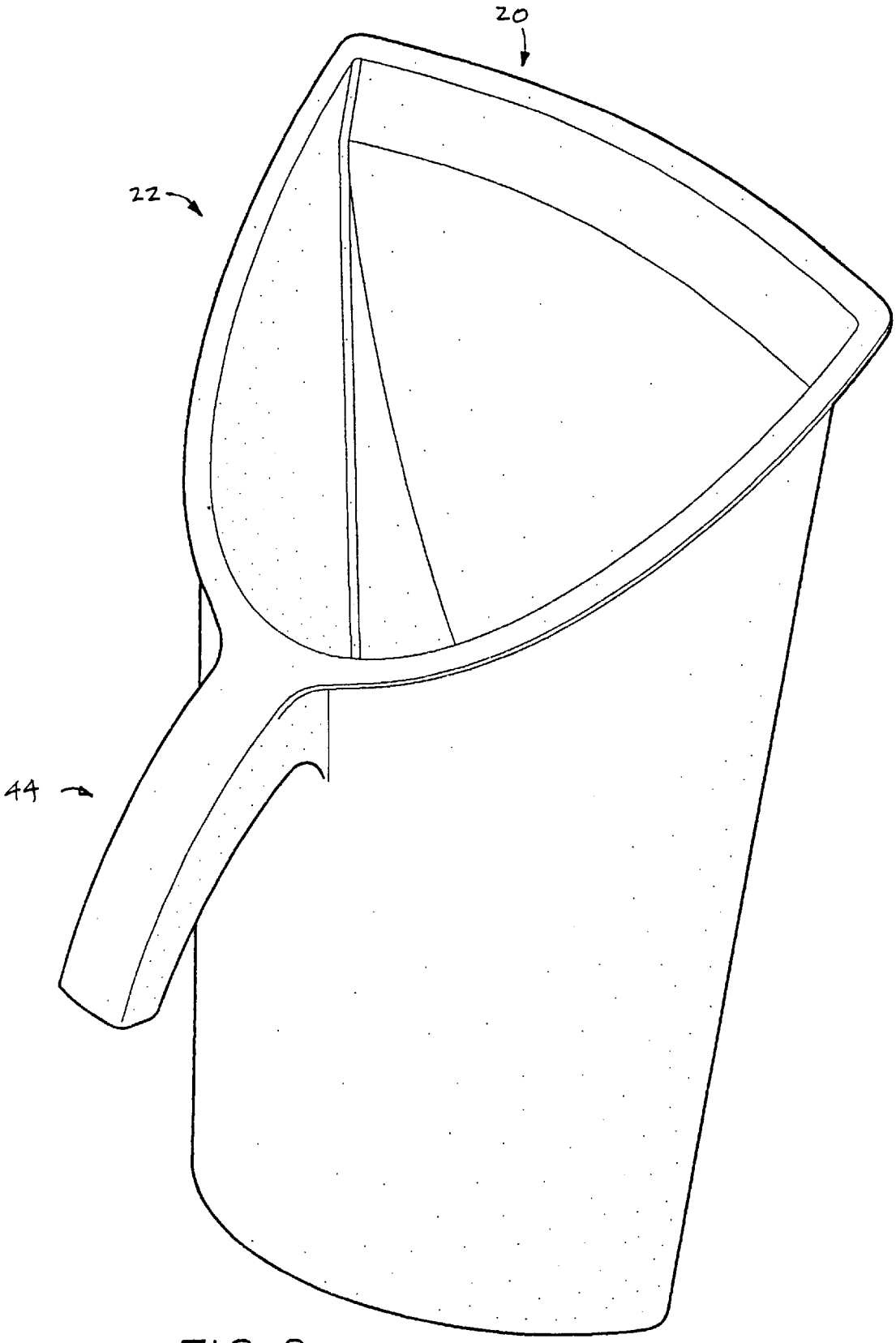
FIG. 9 is a perspective view of an alternative embodiment of my invention.

In operation the dustpan is generally similar to most prior art. With one hand the user picks up the dustpan by its handle 44 and lightly presses it to the floor or similar surface to be cleaned of dirt and debris. With the other hand he uses a brush, broom or similar device to sweep dirt and debris over the lip 20 and into the receptacle 22. However, in storage the dustpan differs from prior art in that it can be stored upright without emptying the receptacle of its contents. The user merely rotates the dustpan lip upward by rotating his wrist accordingly, and stands the dustpan on its receptacle end wall. In its preferred embodiment the receptacle end wall 40 is curved so that its far corners 42, 43 and the handle far end 48 form a stable tripod base for the dustpan's upright storage position. The planar surface defined by the handle end 48 and corners of the receptacle end wall 40 is more or less perpendicular to receptacle bottom 24, in order that the center of gravity of the dustpan and its contents be positioned within these three tripod points. This keeps the dustpan from tipping over. Alternatively, the receptacle end wall may extend significantly beyond the handle far end, as long as it is angled such that the center of gravity of the dustpan and its contents is more or less centered on the end wall when stored in its upright position. An example of this alternative embodiment of my invention is illustrated in FIG. 9.

In its preferred embodiment the dustpan lip 20 has a slight convex curve so that its center 21 touches the floor first, and slight pressure by the user then brings the rest of the lip against the floor. This helps prevent dust and debris from being swept under the receptacle bottom 24. The portion 30 of the receptacle bottom furthest from the lip has a slight concave curve so that the corners of the receptacle end wall 42, 43 act as feet or supports that ensure that in use the center of the dustpan lip always touches the floor first.

To help strengthen and stiffen the relatively flat receptacle bottom 24, the convex curve of dustpan lip 20 described above continues across a portion of the receptacle bottom adjacent to the lip 26, and further across a central portion of the receptacle bottom 28. Geometrically, this central portion of the receptacle bottom 28 is thus the partial section of the surface of a cylinder. Geometrically, the concave curve on the portion of the receptacle bottom furthest from the lip 30 is also a partial section of the surface of a cylinder, in this case curved in the opposite direction. In side view the centerlines of these two cylinders are angled obtusely apart, preferably two to three degrees, so that a parabolic intersection line 58 appears more or less centrally located on the receptacle bottom 24 where the cylindrical surface sections meet.

As described above, a curved lip is advantageous in that it helps prevent sweepings from going underneath a dustpan. Since most molded thermoplastic resin parts tend to warp or shrink inward after they are removed from their molding dies, a curved lip is also advantageous on a molded dustpan because, if enough curvature is built into the die, the molded lip can warp inward considerably yet still retain its preferred convex curve. However, the curved die parting lines required to mold curved dustpan lips are more expensive to fabricate and maintain than straight or planar die parting lines.

My dustpan teaches a novel way to mold a convex curved lip without requiring a corresponding curved die parting line. Essentially, it is based on the fact that passing a plane through a cylinder at an angle produces an elliptical cross-section. Thus, if a straight or planar die parting line 56 passes at an angle through that portion of the receptacle bottom 24 that has a convex curve, the resulting cross-section can produce the lip curvature required to help prevent sweepings from going underneath a dustpan, yet not require a corresponding curved die parting line. Preferably this requires an acute angle between the die parting line plane 56 and the central portion of the receptacle bottom 28 of between twenty and forty five degrees, combined with a convex receptacle bottom curvature radius of between thirty and sixty inches. Though molding considerations favor these dimensions, embodiments of the invention can employ other dimensions as well.

The lip 20 can be part of the injection-molded structure, or it can be a separate resilient attachment around a lip structure. For example, a cut segment of an elastomeric extrusion may be separately fit onto the lip. This resilient lip provides a flexible surface that helps keeps the dustpan flush with a rough or uneven floor, and in use further prevents sweepings from going underneath the dust pan.

The present invention has now been described in connection with a number of specific embodiments thereof. However, numerous modifications that are contemplated as falling within the scope of the present invention should now be apparent to those skilled in the art.

I claim:

1. A dustpan, comprising:

a receptacle comprising:

a receptacle bottom having a lip at the front edge, and a rear edge connected to the lip by left and right side edges, and a receptacle end wall having a top and bottom edge connected by left and right edges, with the bottom edge attached at an angle to the rear edge of the receptacle bottom, and a receptacle left side and right side, each with a top and bottom edge connected by a front and rear edge, the front edge forming an acute angle with the bottom edge, each bottom edge attached to the corresponding left and right side edges of the receptacle bottom, and each rear edge attached to the corresponding left and right edges of the receptacle end wall, and a receptacle top with a front and rear edge connected by left and right edges, with the rear edge connected at an angle to the top edge of the receptacle end wall, and the left and right edges connected to the corresponding top edges of the receptacle left and right sides, and a receptacle opening beginning at the lip, extending along the front edges of the receptacle left and right sides, and generally ending at the front edge of the receptacle top, and a handle having near and far ends, with the near end centrally attached to the front edge of the receptacle top, and the far end unsupported and extending away from the receptacle opening more or less perpendicular to the lip and generally at the same angle as that defined by the acutely angled front edges of the receptacle sides, and ending before reaching a geometric plane that is substantially in line with the receptacle end wall.

2. A dustpan, comprising:

a receptacle comprising:

a receptacle bottom having a lip at the front edge, and a rear edge connected to the lip by left and right side edges, and a receptacle end wall having a top and bottom edge connected by left and right edges, with the bottom edge attached at an angle to the rear edge of the receptacle bottom, and a receptacle left side and right side, each with a top and bottom edge connected by a front and rear edge, the front edge forming an acute angle with the bottom edge, each bottom edge attached to the corresponding left and right side edges of the receptacle bottom, and each rear edge attached to the corresponding left and right edges of the receptacle end wall, and a receptacle top with a front and rear edge connected by left and right edges, with the rear edge connected at an angle to the top edge of the receptacle end wall, and the left and right edges connected to the corresponding top edges of the receptacle left and right sides, and a receptacle opening beginning at the lip, extending along the front edges of the receptacle left and right sides, and generally ending at the front edge of the receptacle top, and a handle having near and far ends, with the near end centrally attached to the front edge of the receptacle top, and the far end unsupported and extending away from the receptacle opening more or less perpendicular to the lip and generally at the same angle as that defined by the acutely angled front edges of the receptacle sides, and ending at a geometric plane that is substantially in line with the receptacle end wall.

* * * * *